US005357087A

United States Patent [19]

Choi

[11] Patent Number: 5,357,087

[45] Date of Patent: Oct. 18, 1994

[54] METHOD FOR CONTROLLING A POWER RELAY FOR ACTUATING A MAGNETRON OF A MICROWAVE OVEN

[75] Inventor: Kyunghwan Choi, Kyungsangnam, Rep. of Korea

[73] Assignee: Goldstar Co., Ltd., Seoul, Rep. of Korea

[21] Appl. No.: 76,145

[22] Filed: Jun. 14, 1993

[30] Foreign Application Priority Data

Jun. 15, 1992 [KR] Rep. of Korea ..... 1992-10386

[51] Int. Cl.[5] ..... H05B 6/68

[52] U.S. Cl. ..... 219/721; 219/716; 219/719; 219/723

[58] Field of Search ..... 219/10.55 B, 10.55 C, 219/721, 722, 723, 719, 715, 716, 718, 702

[56] References Cited

U.S. PATENT DOCUMENTS

| | | | |
|---|---|---|---|
| 4,378,487 | 3/1983 | Maeda | 219/712 |
| 4,394,557 | 7/1983 | Tachihara et al. | 219/719 |
| 4,467,164 | 8/1984 | Nakata et al. | 219/711 |
| 4,987,556 | 1/1991 | Aoki | 364/580 |

*Primary Examiner*—Philip H. Leung

[57] ABSTRACT

A method for controlling a power relay for actuating a magnetron of a microwave oven in which contacts thereof are closed at various points of time or phase of an AC sinusoidal waveform input thereto with an equal probability, thereby preventing a transfer of the contacts of the power relay. According to the present invention, a count number of a relay counter is incremented periodically upon application of power, until a start key signal is inputted. The count number of the relay counter is then incremented by 1 whenever the start key signal is inputted and the power relay is toggled from its off state to its on state. An interrupt number is incremented periodically as the count number of the relay counter whenever an internal or external interrupt routine is performed. When the count number of the relay counter and the interrupt number are the same, the contacts of the power relay are closed at a phase or a point of time corresponding to the same number, so as to actuate the magnetron. Therefore, the power relay is driven initially at a random phase upon application of power and at the next phase when the magnetron is to be turned on after it is temporarily turned off since the power level is not full or when the operation of the microwave oven is restarted due to the re-input of the start key signal after the operation is stopped with its door open in operation.

6 Claims, 5 Drawing Sheets

METHOD FOR CONTROLLING A POWER RELAY FOR ACTUATING A MAGNETRON OF A MICROWAVE OVEN

BACKGROUND OF THE INVENTION

1. Field of the Invention

The present invention relates in general to the control of a power relay for actuating a magnetron of a microwave oven, and more particularly to a method for controlling the power relay in which contacts thereof are closed at various points of time or phase of an alternating current (AC) waveform input thereto with an equal probability, thereby preventing a transfer of the contacts of the power relay.

2. Description of the Prior Art

Referring to FIG. 1, there is shown a block diagram of a conventional relay control circuit for a microwave oven. As shown in this drawing, the conventional relay control circuit comprises a microcomputer 2 for controlling components of the microwave oven, a power supply 3 for supplying power to the components of the microwave oven as a power cord of the microwave oven is connected to a power source, a main relay 4 for actuating an oven lamp 6, a fan motor 7 and etc., a power relay 8 for actuating a magnetron, a relay driver 5 for driving the main relay 4 and the power relay 8 under the control of the microcomputer 2, and a key input unit 1 for inputting information about cooking which is required by the user.

In operation, first, the power supply 3 supplies a standby power to the components of the microwave oven as the power cord is plugged in the power source. The microcomputer 2 is energized by the standby power from the power supply 3, so as to scan a key input signal from the user. When the user pushes a start key after he places food to be cooked in a heating chamber (not shown) of the microwave oven and finishes inputting key inputs, the microcomputer 2 controls the relay driver 5 to drive the main relay 4 so that the oven lamp 6 and the fan motor 7 can be actuated. The microcomputer 2 then controls the relay driver 5 to drive the power relay 8 so that the magnetron can be actuated.

At this time, if contacts of the power relay 8 continue to be closed at a particular phase of an AC sinusoidal waveform, a transfer of the contacts of the power relay 8 may occur. As a result, the contacts of the power relay 8 are subjected to a damage due to the transfer. For this reason, it is preferred to make the contacts of the power relay 8 closed at, various phases of time or phase of the AC sinusoidal waveform with an equal probability.

For the purpose of preventing the transfer of the contacts of the power relay, there have conventionally been proposed a method for actuating the magnetron of the microwave oven using a triac instead of the power relay.

FIG. 2A is a waveform diagram illustrating the conventional method for actuating the magnetron of the microwave oven using the triac. In this case, the magnetron is actuated at the peak phase of a voltage of an AC sinusoidal waveform which is applied into the microcomputer for time check. The reason is as follows. A current lags behind a voltage by $\pm\pi/2$ in phase, since the power of the AC sinusoidal waveform is applied to the magnetron through a high voltage transformer (HVT). As a result, the current becomes "0" at the point of time that the voltage becomes the peak. This helps minimizing an inrush current. Further, the magnetron can be actuated at the same phase that the power relay is driven, because the sinusoidal waveforms applied to the microcomputer and to the power relay are different in amplitude but the same in phase. Also, since switching time of the triac is several [ns] which is very shorter than that of the power relay, the magnetron can be actuated accurately at the point of time that the voltage becomes the peak.

However, the above method using the triac has a disadvantage, in that it is not economical since the triac is very expensive. Also, a separate cooling system must be provided because a consumption power of the triac is commonly 1300 W or above.

FIG. 2B is a waveform diagram illustrating another conventional method for actuating the magnetron of the microwave oven using the power relay, with the purpose of preventing the transfer of the contacts of the power relay. This method is a positive-negative random crossing method which controls the point of time that the power relay is driven, in such a manner as (+) 1→(−) 2→(+) 3→—(−) 8→(+) 1—at random phases of the sinusoidal waveform applied to the microcomputer. The purpose of this method is to prevent the contacts of the power relay from being damaged due to the transfer in the case where the contacts of the power relay continue to be closed at a particular phase of the sinusoidal waveform. In this case, an interval between the adjacent power relay driving points of time can be obtained by controlling the phase of the AC sinusoidal waveform applied to the microcomputer. Assuming that a frequency of the AC sinusoidal waveform applied to the microcomputer is 60 Hz and the time of a period is thus 1/60 sec, the interval between the adjacent power relay driving points of time is 1/480 sec ($1/60\times 1/8$) since a period includes 8 of the power relay driving points of time as shown in FIG. 2B. As a result, the power relay driving point of time is delayed by 1/480 sec with respect to the positive and negative phases of the AC sinusoidal waveform.

However, the above method using the power relay is disadvantageous in that the cost is increased since a control program is very complex, resulting in an increase in a size of a ROM.

SUMMARY OF THE INVENTION

Therefore, the present invention has been made in view of the above problems, and it is an object of the present invention to provide a method for controlling a power relay for actuating a magnetron of a microwave oven in which contacts thereof are closed at various points of time or phase of an alternating current (AC) waveform input thereto with an equal probability, thereby preventing a transfer of the contacts of the power relay.

In accordance with one aspect of the present invention, there is provided a method for controlling a power relay for actuating a magnetron of a microwave oven, comprising the steps of: incrementing a count number of a relay counter periodically and continuously upon application of power, until a start key signal is inputted; incrementing the count number of said relay counter whenever the start key signal is inputted; incrementing the present count number of said relay counter whenever said power relay is toggled from its off state to its on state; and driving said power relay to actuate said magnetron, if the present count number of said relay counter and an interrupt number which has been incremented whenever an internal or external interrupt routine is performed are the same, at a phase or a point of time corresponding to the same number.

When a power level selected by the user is not a full level, the microwave oven continuously turn on and off the magnetron periodically to control the power level in accordance with a time ratio of magnetron on time and magnetron off time.

In addition, if a door of the microwave oven is opened while the magnetron is actuated, the operation of the magnetron is interrupted. When the start key is pressed after the door is closed by the user, the magnetron would be re-actuated.

In both cases above-mentioned, the magnetron, after an interrupt, has to be re-actuated at a phase different from the phase it actuated.

In accordance with another aspect of the present invention taking into account the above-mentioned matter, there is provided a method for controlling a power relay for actuating a magnetron of a microwave oven, comprising the steps of: incrementing a count number of a relay counter periodically upon application of power, until a start key signal is inputted; incrementing the count number of said relay counter whenever the start key signal is inputted; setting a power relay flag when a power level inputted by the user is full level; discriminating whether a magnetron on or off time has elapsed by checking a present value of a magnetron on/off time setting counter is 0, if the power level is not full level; setting a magnetron on time for a next power level period based on the power level inputted by the user in said magnetron on/off time setting counter, incrementing the count number of said relay counter and setting the power relay flag, if the magnetron on or off time has elapsed; driving said power relay to actuate said magnetron, if the present count number of said relay counter and an interrupt number which has been incremented whenever an internal or external interrupt routine is performed are the same and if the power relay flag has been set, at a phase of a point of time corresponding to the same number; decrementing the present value of said magnetron on/off time setting counter by 1 and discriminating again whether the present value of said magnetron on/off time setting counter is 0, if the magnetron on or off time has not elapsed; discriminating whether the power relay flag has been set if the present value of said magnetron on/off time setting counter is 0; setting the magnetron on time in said magnetron on/off time setting counter, incrementing the count number of said relay counter to determine the next driving point of time and setting the power relay flag, if the power relay flag has not been set; and setting the magnetron off time in said magnetron on/off time setting counter and resetting the power relay flag, if the power relay flag has been set.

BRIEF DESCRIPTION OF THE DRAWINGS

The above and other objects, features and advantages of the present invention will be more clearly understood from the following detailed description taken in conjunction with the accompanying drawings, in which:

FIG. 3 is a block diagram of a relay control circuit for a microwave oven in accordance with the present invention;

DETAILED DESCRIPTION OF THE INVENTION

Figure 1:
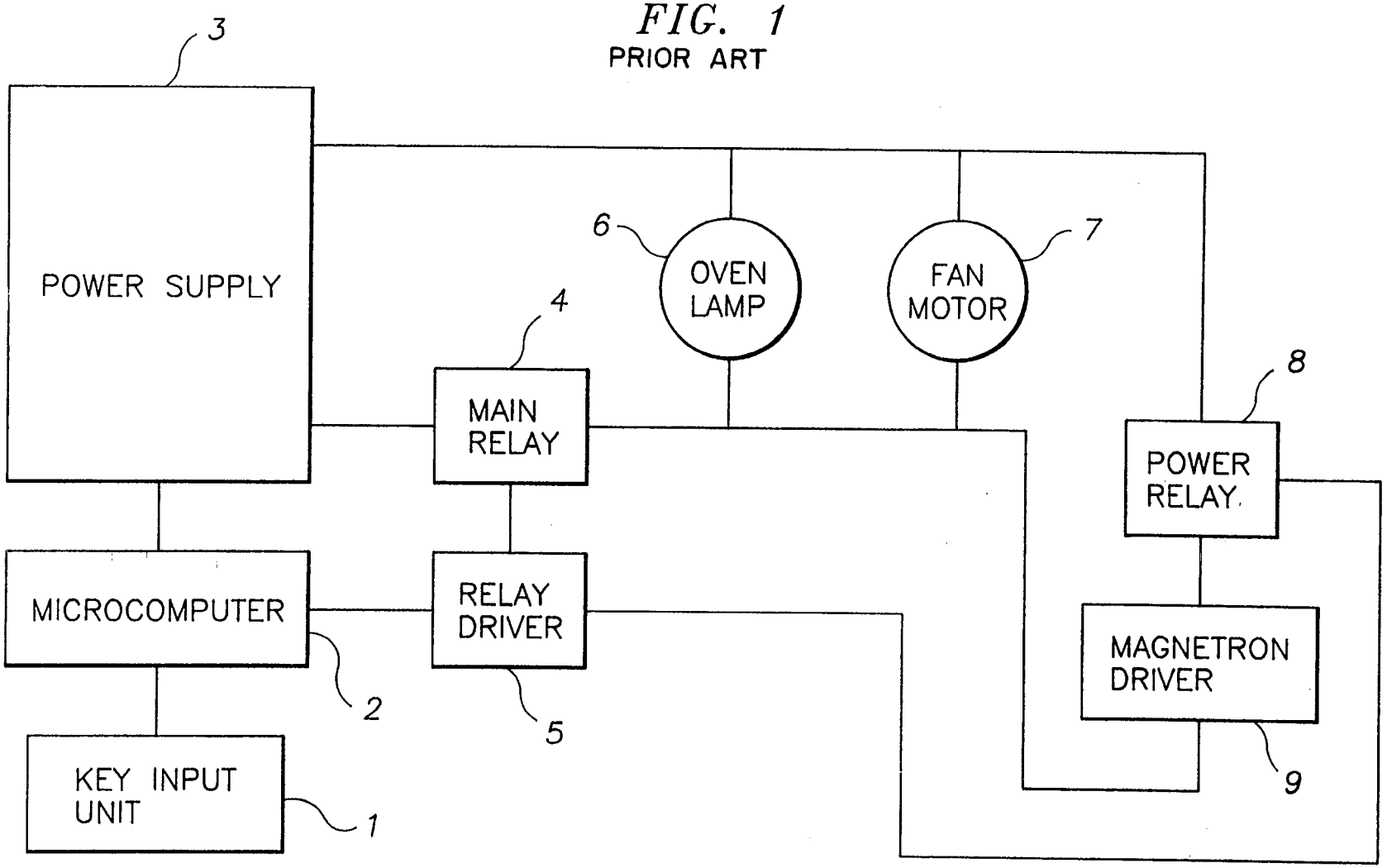
FIG. 1 PRIOR ART
FIG. 1 is a block diagram of a conventional relay control circuit for a microwave oven.
Figure 2A:
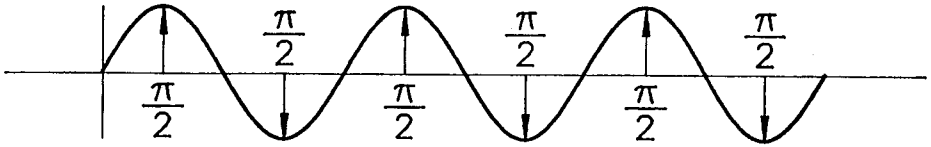
FIG. 2A PRIOR ART
FIG. 2A is a waveform diagram illustrating a method for actuating a magnetron of a microwave oven using a triac in accordance with the prior art.
Figure 2B:
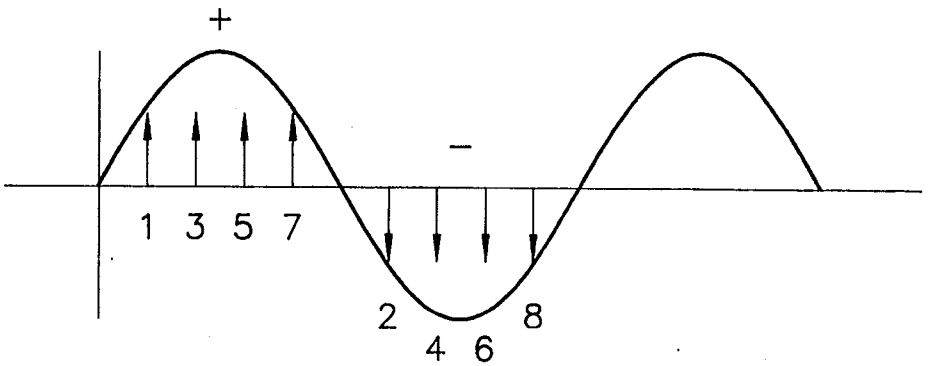
FIG. 2B PRIOR ART
FIG. 2B i s a waveform diagram illustrating a method for actuating a magnetron of a microwave oven using a power relay in accordance with the prior art.

A feature of the present invention is to control a power relay for actuating a magnetron of a microwave oven in which contacts thereof are closed at various points of time or phase of an AC waveform input thereto with an equal probability, thereby preventing a transfer of the contacts of the power relay. A count number of a relay counter is incremented periodically upon application of power, until a start key signal is inputted. The count number of the relay counter is then incremented by 1 whenever the start key signal is inputted or the power relay is toggled from its off state to its on state. An interrupt number is incremented whenever an internal or external interrupt routine is performed. The increment of the interrupt number has the same period as that of the count number of the relay counter. When the count number of the relay counter and the interrupt number are the same, a point of time or phase corresponding to the same number is determined as a power relay driving point of time or phase. Herein, the periodical increment of the count number of the relay counter signifies that the increment of the count number from 1 to a predetermined number is repeatedly performed.

Referring to FIG. 3, there is shown a block diagram of a relay control circuit for a microwave oven in accordance with the present invention. As shown in this drawing, the relay control circuit comprises a microcomputer 10 for controlling components of the microwave oven, a power supply 11 for supplying power to the components of the microwave oven, an oscillating circuit 12 for providing a reference frequency necessary to the control of the microwave oven, a relay driving circuit 13 for driving main and power relays (not shown) under the control of the microcomputer 10, a buzzer circuit 14 for giving a buzzer under the control of the microcomputer 10, a display circuit 15 for displaying an operating state of the microwave oven under the control of the microcomputer 10, and a key scanning circuit 16 for scanning a key input signal from the user.

With the above-mentioned construction, a method for controlling the power relay for actuating the magnetron of the microwave oven in accordance with the present invention is performed on the basis of the following two fundamental rules.

The first one is that a count number of a relay counter (not shown) is incremented when the power is turned on or a power cord is plugged in a power source, until a start key signal is inputted and the main relay is thus driven. This allows an initial actuation of the power relay to be performed at a random point of time.

The second one is that the present count number of the relay counter is incremented by 1 whenever the start key signal is inputted and the main relay is thus turned on or whenever the power relay is toggled from its off state to its on state. Then, when the count number of the relay counter and an interrupt number which has been incremented whenever an interrupt routine is performed are the same, the power relay is driven at a phase or a point of time of the AC sinusoidal waveform corresponding to the same number. The above rules are valid as long as the power cord remains plugged in the power source.

Figure 6:
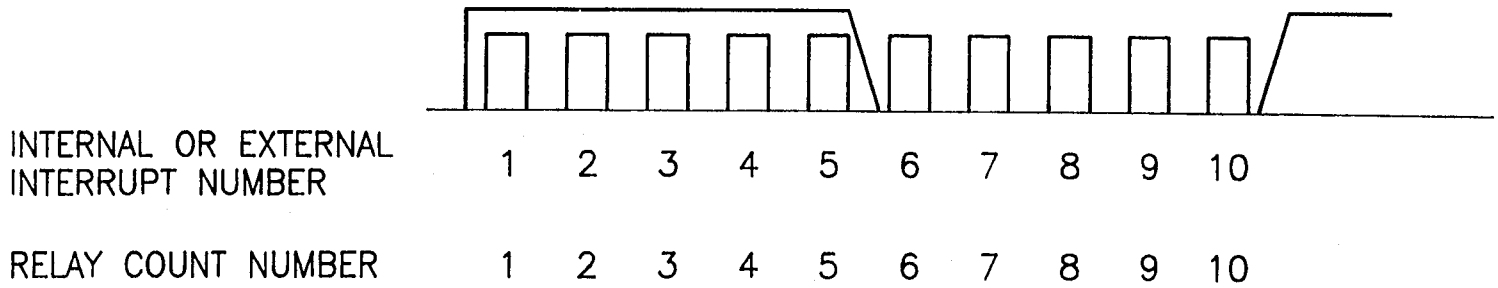
FIG. 6 is a waveform diagram illustrating the power relay control method in accordance with the present invention.

The counting-up of the relay counter is closely related to the power relay driving points of time for a period of the AC sinusoidal waveform. Namely, since the total number of the power relay driving points of time is 10 for the period of the AC sinusoidal waveform as shown in FIG. 6, the counting-up of the relay counter is performed from 1 to 10 and then begins with 1 again. In other words, the counting-up of the relay counter is performed periodically. Herein, the power relay driving points of time or phases mean points that the power relay is to be driven, or phases of those points of time, and are obtained by dividing a period of the AC sinusoidal waveform by a desired time interval.

Figure 4:
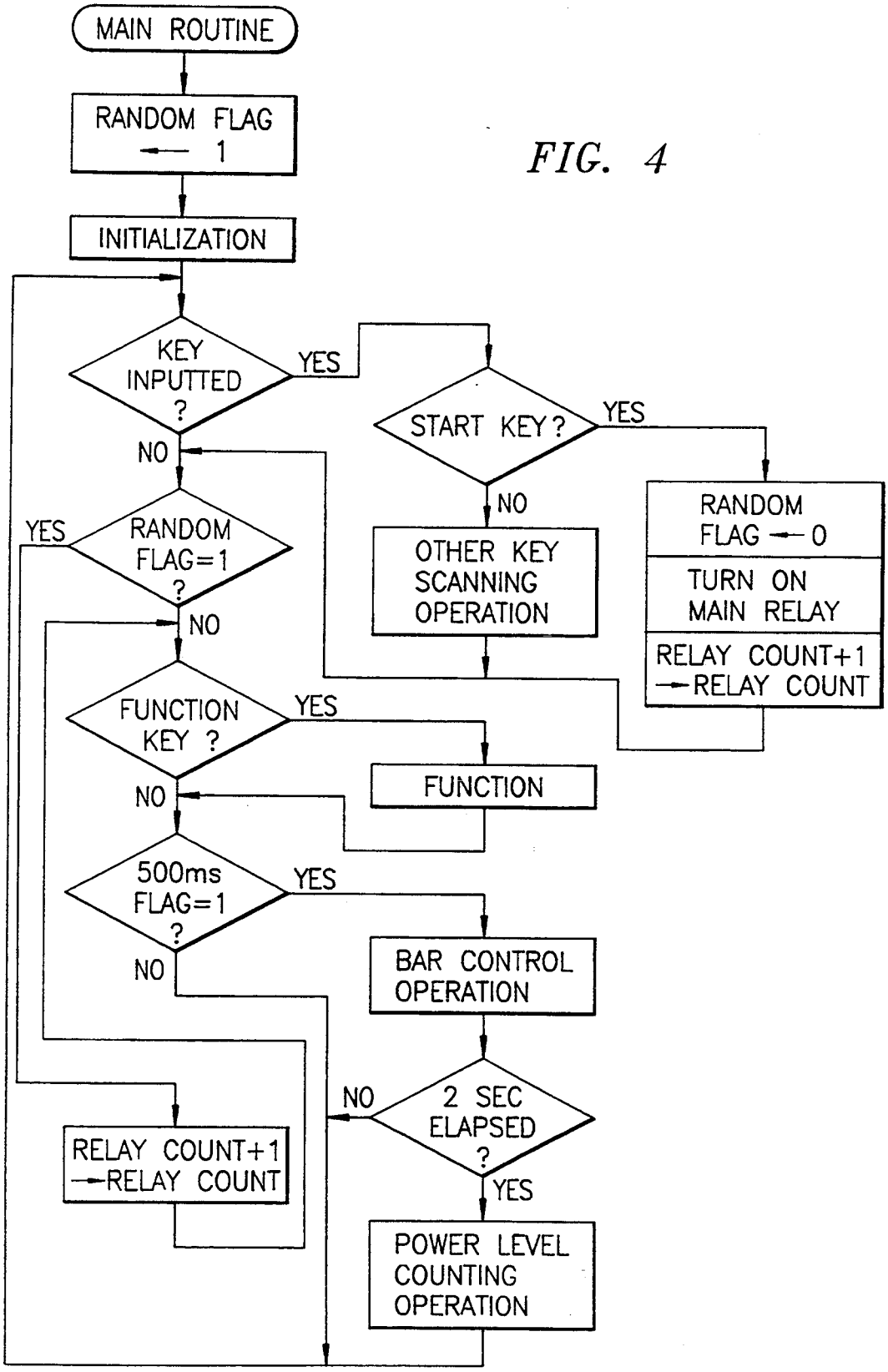
FIG. 4 is a flowchart illustrating a method for controlling a power relay for actuating a magnetron of a microwave oven in accordance with the present invention.
Figure 5:
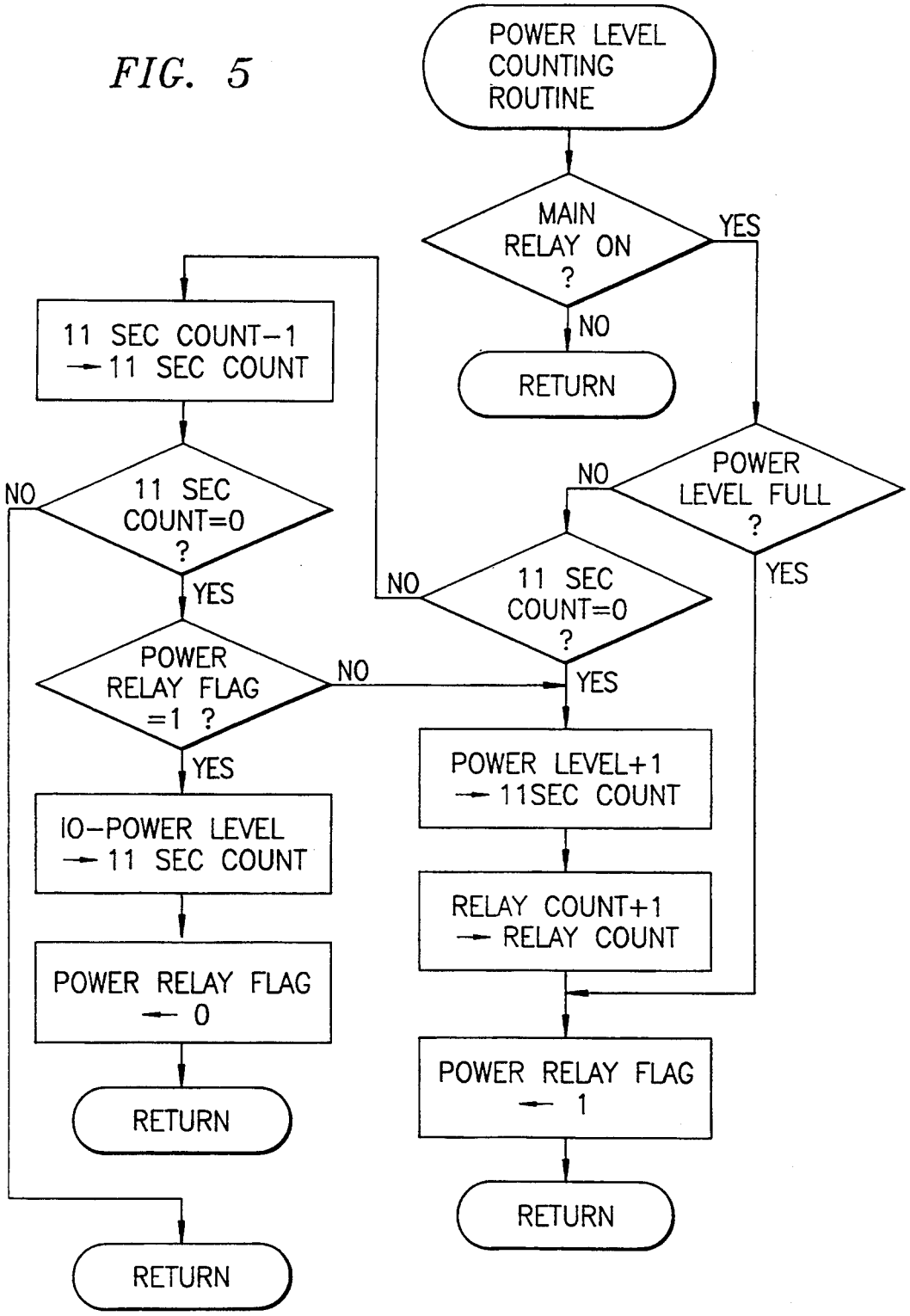
FIG. 5 is a flowchart illustrating a power level counting operation in accordance with the present invention.

The method for controlling the power relay for actuating the magnetron of the microwave oven in accordance with the present invention will hereinafter be described in detail with reference to FIGS. 4 to 6.

In operation, when the power of the microwave oven is turned on or the power cord is plugged in the power source, a random flag is set and an initializing operation is performed.

It is then checked whether a key input signal is present. If it is checked that no key input signal is present or a start key signal is not inputted although the key input signal is present, it is checked whether the random flag has been set. When it is checked that the random flag has been set, the present count number of the relay counter is incremented by 1. In this manner, the count number of the relay counter is incremented continuously until the start key signal is inputted and the main relay is thus driven. As a result, contacts of the power relay can be closed initially at a random point of time upon application of power so that the magnetron can be driven at that point.

On the other hand, since the total number of the power relay driving points of time is 10 for the period of the AC sinusoidal waveform as shown in FIG. 6, the counting-up of the relay counter is performed from 1 to 10 and then begins with 1 again. In this case, assuming that a frequency of the AC sinusoidal waveform is commercial 60 Hz, the interval between the adjacent power relay driving points of time is 1/600 sec ($1/60 \times 1/10$).

In the case where the presence of the key input signal is checked, it is checked whether the key input signal is the start key signal. If the key input signal is the start key signal, the random flag is reset, thereby to stop the counting-up of the relay counter. Then, the main relay is turned on and the present count number of the relay counter is incremented by 1. Namely, the count number of the relay counter is incremented whenever the start key signal is inputted. As a result, when the operation of the microwave oven is restarted due to the re-input of the start key signal after the operation is stopped with its door open in operation, the power relay can be driven at the next driving point of time.

When the count number of the relay counter is determined as mentioned above, it is checked whether a function key has been inputted. If it is checked that the function key has been inputted, the operation is performed corresponding to the inputted function key. It is then checked whether a 500 ms flag has been set. If the 500 ms flag has been set, a bar control operation is performed. The lapse of time is checked under the condition of the bar control operation. As a result of the checking, a power level counting operation is performed every 2 sec.

In accordance with the present invention, a power level control is performed in a time division or time ratio manner in which an on/off time ratio of the magnetron is controlled for a fixed time of power level period so that its output is controlled. In the present invention, for example, a full power level is 10 and a power level period is 22 sec. In other words, the power level counting routine has a period of 11 sec and is performed every 2 sec.

The power level counting operation will hereinafter be described with reference to FIG. 5.

It is first checked whether the main relay has been turned on. If it is checked that the main relay has not been turned on, the operation is returned to the next routine. If the main relay has been turned on, it is checked whether the power level is full level. When the power level is full level, a power relay flag is set and the operation is returned to the next routine. When the power level is not full level, it is checked whether a count number of an 11 second counter as the magnetron on/off time setting counter is 0. If the count number of the 11 sec-counter is 0, 1 is added to the power level and the resultant value is then set in the 11 sec-counter as a magnetron on time for a next power level period. Also, the present count number of the relay counter is incremented by 1, thereby to determine the next power relay driving point of time. Then, the power relay flag is set and the operation is then returned to a main routine.

On the other hand, if the count number of the 11 sec-counter is not 0, the magnetron would be in process of its on or off state. In this case, the count number of the 11 sec-counter is decremented by 1 (really, 2 sec) and it is again checked whether the count number of the 11 sec-counter is 0. If the count number of the 11 sec-counter is still not 0, the operation is returned to the next routine since the magnetron would be in process of its on or off state. On the contrary, when the count number of the 11 sec-counter is 0, it is checked whether the power relay flag has been set.

The case where the count number of the 11 sec-counter has decreased to 0 and the power relay flag has been set signifies that the magnetron on time has just elapsed. In this case, the magnetron off time of the power level period is obtained by subtracting the power level from 10 sec and is then set in the 11 sec-counter. Then, the power relay flag is reset and the operation is then returned to the next routine.

The case where the count number of the 11 sec-counter is 0 and the power relay flag has not been set signifies that the magnetron off time has just elapsed. In this case, the operation is performed similarly to that in the case where the power level is not full level as mentioned above. Namely, a magnetron on time for a next power level period is obtained by adding 1 to the power level and set in the 11 sec-counter. Also, the present count number of the relay counter is incremented by 1, thereby determining the next driving point of time. Then, the power relay flag is set and the operation is then returned to the next routine.

Figure 7:
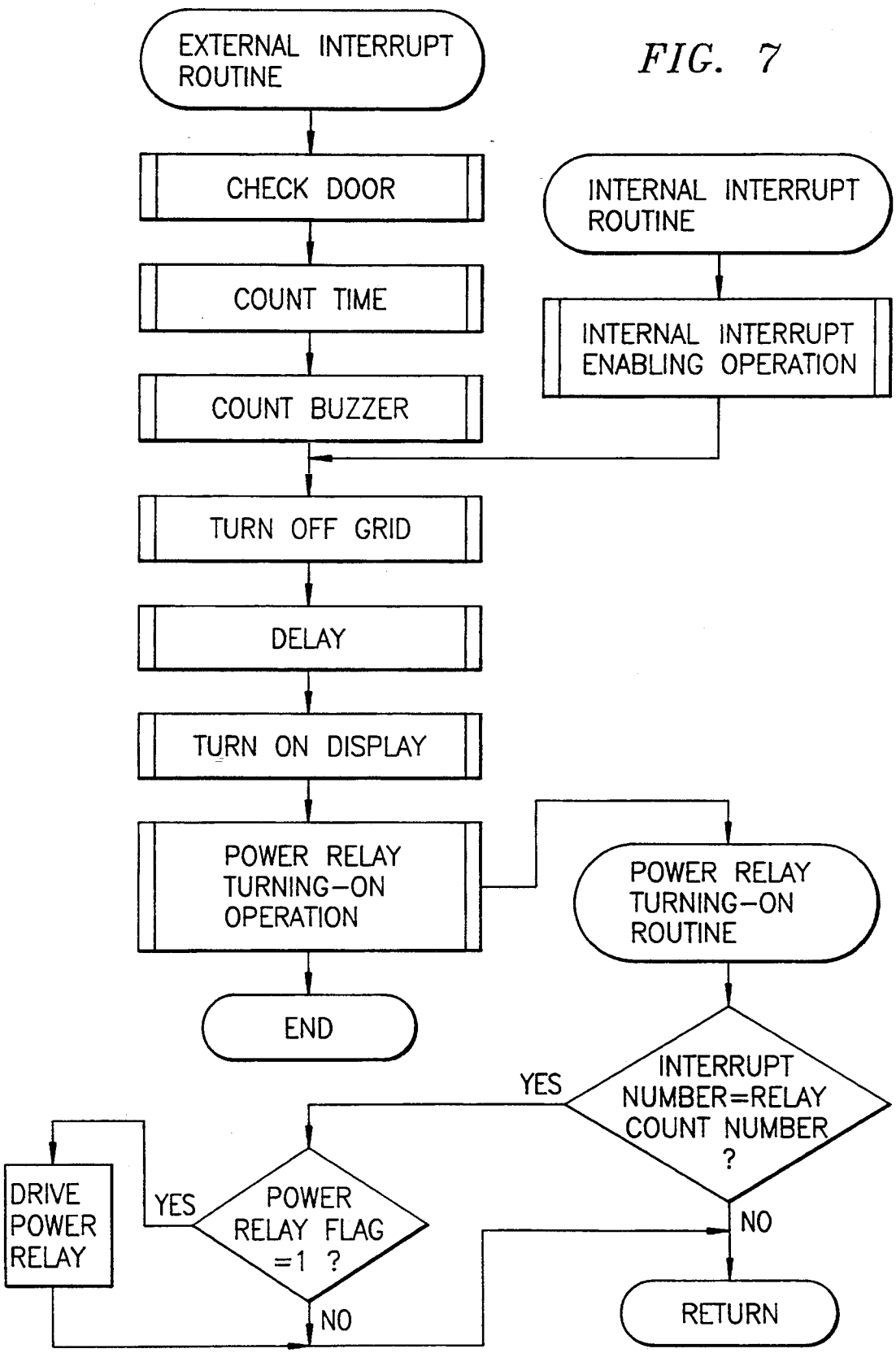
FIG. 7 is a flowchart illustrating interrupt routine operations in accordance with the present invention.

The interrupt routine operations will hereinafter be described with reference to FIG. 7.

In accordance with the present invention, door checking, time counting and buzzer counting operations are performed in the external interrupt routine and an internal interrupt enabling operation is performed in the internal interrupt routine. After the performance of the external and internal interrupt routine operations, a grid is turned off to reset the display and, after the lapse of a predetermined time, an anode and the grid are turned on to turn on the display. A power relay turning-on operation is then performed.

The power relay turning-on operation comprises the steps of comparing the present count number of the relay counter with the interrupt number having been incremented whenever an interrupt routine is performed, driving the power relay to actuate the magnetron when the present count number of the relay counter and the interrupt number are the same and the power relay flag has been set, at the point of time or the phase corresponding to the same number, and returning the operation to the next routine when the count number of the relay counter and the interrupt number are not the same or the power relay flag has not been set.

Assume that the power level is set to 5 which is half the full level and the start key signal is inputted at the moment when the count number of the relay counter has come to 6. In operation, when the power of the microwave oven is turned on or the power cord is plugged in the power source, the random flag is set and the initializing operation is performed.

The count number of the relay counter is incremented continuously and continuously until the start key signal is inputted. When it is checked that the start key signal is inputted at the moment when the count number of the relay counter is 6, the random flag is reset, thereby causing the counting-up of the relay counter to be stopped. Also, the main relay is driven and the count number of the relay counter is incremented by 1. As a result, the present count number of the relay counter is 7.

When the count number of the relay counter is determined as mentioned above, it is checked whether a function key has been inputted. If it is checked that the function key has been inputted, the operation is performed corresponding to the inputted function key. It is then checked whether the 500 ms flag has been set. If the 500 ms flag has been set, the bar control operation is performed. These are for checking the lapse of time. As a result of the checking, the power level counting operation is performed every 2 sec.

In the power level counting operation, it is checked whether the count number of the 11 sec-counter is 0 since the set power level is not full level. This is performed to check whether the magnetron on or off time has elapsed. The case where the count number of the 11 sec-counter is 0 signifies that the magnetron on or off time has elapsed. On the contrary, the case where the count number of the 11 sec-counter is not 0 signifies that the present moment is still in process of the magnetron on or off time.

In the initial condition, the count number of the 11 sec-counter is 0. Accordingly, 1 is added to the power level 5 and the resultant value of 6 is then set in the 11 sec-counter as the magnetron on time of the magnetron driving period. Also, the present count number of the relay counter is incremented by 1 (the number=8), thereby to determine the next power relay driving point of time. Then, the power relay flag is set and the operation is then returned to the next routine.

Thereafter, in the power relay turning-on routine, the present count number (8) of the relay counter is compared with the interrupt number. If the present count number of the relay counter and the interrupt number are the same, the power relay is driven at the phase corresponding to the same number, so as to actuate the magnetron. Namely, the power relay is driven at the eighth phase in FIG. 6. If not the same, the operation is returned to the next routine.

Then, in the power level counting operation, it is checked whether the power level is full level. It is then checked whether the count number of the 11 sec-counter is 0, since the power level is not full level. At this time, since the 11 sec-counter was previously set to the magnetron on time, the count number is not 0. As a result, 1 sec (really 2 sec because the power level counting operation is performed every 2 sec) is subtracted from the magnetron on time of the 11 sec-counter. Then, it is again checked whether the count number of the 11 sec-counter is 0. The operation is returned to the next routine since the count number of the 11 sec-counter is still not 0.

The above procedure is performed continuously. When the count number of the 11 sec-counter becomes 1 with the lapse of 5 sec (10 sec), the power level and the count number of the 11 sec-counter are checked. Because the power level is not full level and the count number is not 0, the count number of the 11 sec-counter is decremented by 1 and comes to 0. At this time, it is checked whether the power relay flag has been set. The power relay flag has been set because the magnetron has been at its on state so far. As a result, the power level 5 is subtracted from 10 and the resultant value, 5, is then set in the 11 sec-counter as the magnetron off time of the power level period. Then, the power relay flag is reset and the operation is then returned to the next routine.

Thereafter, the operation again proceeds to the power level counting routine via the main routine. In the power level counting operation, it is checked whether the count number of the 11 sec-counter is 0, since the power level is not full level. At this time, since the 11 see-counter was previously set to the magnetron off time of the power level period, the count number is not 0. As a result, 1 sec (2 sec) is subtracted from the count number of the 11 sec-counter. Then, it is checked again whether the count number of the 11 sec-counter is 0. The operation is returned to the next routine since the count number of the 11 sec-counter is still not 0.

The above procedure is performed continuously. If the count number of the 11 sec-counter becomes 1 with the lapse of 4 sec (8 sec), the power level and the count number of the 11 see-counter are checked. Because the power level is not full level and the count number is not 0, the count number of the 11 sec-counter is decremented by 1 and comes to 0. At this time, it is checked whether the power relay flag has been set. The power relay flag must have been reset since the magnetron has been at its off state. As a result, 1 is added to the power level 5 and the resultant value is then set in the 11 sec-counter as the magnetron on time of the next power level period. Also, the present count number of the relay counter is incremented by 1, thereby determining the next driving point of time. Then, the power relay flag is set and the operation is then returned to the next routine.

Next, assume that the operation of the microwave oven is restarted due to the re-input of the start key signal after the operation is stopped with its door open in operation, under the condition that the count number of the 11 sec-counter is 3 and the count number of the relay counter is 8 during the actuation of the magnetron.

First, due to the input of the start key signal, the count number of the relay counter is incremented and comes to 9. In the power level counting operation, it is checked whether the count number of the 11 sec-counter is 0, since the power level is not full level. At this time, since the 11 sec-counter is 3, the count number is not 0. As a result, the count number of the 11 sec-counter is decremented. Then, it is again checked whether the count number of the 11 sec-counter is 0. The operation is returned to the next routine since the count number of the 11 sec-counter is still not 0. Then, in the power relay turning-on routine, when the present count number (9) of the relay counter and the interrupt number are the same, the power relay is driven at the point of time or the phase corresponding to the same number 9 and the magnetron is thus actuated.

As hereinbefore described, the count number of the relay counter is incremented continuously upon application of power, until the start key signal is inputted and the main relay is thus driven, so that the power relay can be driven at a random point of time. The count number of the relay counter is then incremented by 1 whenever the start key signal is inputted or the power relay is toggled from its off state to its on state. The interrupt number is incremented whenever the internal or external interrupt routine is performed. The increment of the interrupt number has the same period as that of the count number of the relay counter. When the count number of the relay counter and the interrupt number are the same, the power relay is driven at a phase or a point of time corresponding to the same number, so as to actuate the magnetron. Therefore, the power relay is driven initially at a random phase upon application of power and at the next phase when the magnetron is to be turned on after it is temporarily turned off due to a power level period operation or a door open interrupt. As a result, according to the present invention, there is provided the method for controlling the power relay for actuating the magnetron of the microwave oven in which contacts thereof are closed at various phases of the AC sinusoidal waveform input thereto with an equal probability, thereby preventing a transfer of the contacts of the power relay.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of controlling a power relay for actuating a magnetron of a microwave oven, comprising the steps of:

incrementing a count number of a relay counter of the microwave oven upon application of power to the microwave oven, continuously during a predetermined period, until a start key signal is inputted;

incrementing the count number of the relay counter whenever the start key signal is inputted;

incrementing a present count number of the relay counter whenever the power relay is toggled from an off state to an on state;

incrementing an interrupt number, which number is a number of times there has been an interruption of the microwave oven; and driving the power relay for actuating the microwave oven when the incremented count number and incremented interrupt number are equal.

2. A method for controlling a power relay for actuating a magnetron of a microwave oven, as set forth in claim 1, further comprising the step of driving a main relay whenever the start key signal is inputted.

3. A method of controlling a power relay for actuating a magnetron of a microwave oven, comprising the steps of:

incrementing a count number of a relay counter periodically upon application of power to the microwave oven, until a start key signal is inputted;

incrementing a count number of the relay counter whenever a start key signal is inputted;

setting a power relay flag when a power level inputted by the user is at a full level;

discriminating whether a magnetron on or off time has elapsed by checking whether the magnetron on or off time setting counter is 0, and if the power level is not at the full level;

setting a magnetron on time for a next power level period based on the power level inputted by the user into said magnetron on or off time setting counter, incrementing the count number of said relay counter and setting the power relay flag, if the magnetron on or off time has elapsed;

driving said power relay to actuate the magnetron, if a present count number of the relay counter and an incremented interrupt number, the interrupt number representing a number of times an interrupt routine has occurred, are equal and if the power relay flag has been set;

decrementing the present value of the magnetron on or off time setting counter by 1 and discriminating again whether the present value of said magnetron on or off time setting counter is 0, thereby determining if the magnetron on or off time has not elapsed;

discriminating whether the power relay flag has been set if the present value of said magnetron on or off time setting counter is 0;

setting the magnetron on time in said magnetron on or off time setting counter, incrementing the count number of the relay counter to determine a next driving point and setting the power relay flag, if the power relay flag has not been set; and setting the magnetron off time in said magnetron on or off time setting counter and resetting the power relay flag, if the power relay flag has been set.

4. A method of controlling a power relay for actuating a magnetron of a microwave oven, as set forth in claim 3, further comprising the step of driving a main relay whenever the start key signal is inputted.

5. A method of controlling a power relay for actuating a magnetron of a microwave oven, the microwave including as operative elements the power relay, a magnetron a start key and a main relay all of said operative elements being operatively connected to each other, comprising the steps of:

incrementing a count of a relay counter, operatively connected to the power relay continuously during a predetermined period upon application of power to the microwave oven, until a signal is inputted by operation of the start key;

incrementing a present count number of said relay counter whenever said power relay is toggled from an off state to an on state; and driving said power relay to actuate said magnetron, when the present count number of said relay counter and an incremented interrupt number are equal to each other, the interrupt number being the number of times an interrupt routine has been performed, the interrupt routine representing an internal or external interruption of the operation of the microwave oven.

6. A method of controlling a power relay, as set forth in claim 5, further comprising the step of driving the main relay whenever the signal is inputted by operation of the start key.

* * * * *